US006904623B2

(12) United States Patent
Ohta et al.

(10) Patent No.: US 6,904,623 B2
(45) Date of Patent: Jun. 14, 2005

(54) DRAIN PLUG STRUCTURE FOR BATH TUB

(75) Inventors: Ikumi Ohta, c/o Japan Alpha Corporation of 1918, Oaza Obuke, Asahi-cho, Mie-gun, Mie-ken (JP); Masaki Ishigaki, Mie-ken (JP); Shinichi Ohta, Mie-ken (JP)

(73) Assignee: Ikumi Ohta, Mie-Ken (JP)

( * ) Notice: Subject to any disclaimer, the term of this patent is extended or adjusted under 35 U.S.C. 154(b) by 0 days.

(21) Appl. No.: 10/629,616

(22) Filed: Jul. 30, 2003

(65) Prior Publication Data

US 2004/0019965 A1 Feb. 5, 2004

(30) Foreign Application Priority Data

Jul. 31, 2002 (JP) ..... 2002-222968
Jun. 30, 2003 (JP) ..... 2003-187780

(51) Int. Cl.[7] ..... A47K 1/14
(52) U.S. Cl. ..... 4/295; 4/689
(58) Field of Search ..... 4/679, 684, 688–694, 4/286, 287, 293, 295

(56) References Cited

U.S. PATENT DOCUMENTS 4,160,293 A * 7/1979 Niemann ..... 4/291
4,411,028 A * 10/1983 Hogner ..... 4/691
4,860,390 A 8/1989 Ohta
5,363,519 A * 11/1994 Husting ..... 4/689
6,347,417 B1 2/2002 Ohta
6,367,102 B1 * 4/2002 McMullen ..... 4/684

FOREIGN PATENT DOCUMENTS

JP 0960073 3/1997
JP 11099077 4/1999

OTHER PUBLICATIONS

English Language Abstract of JP Appln. No. 09–060073.
English Language Abstract of JP Appln. No. 11–099077.

* cited by examiner

*Primary Examiner*—Justine R. Yu
*Assistant Examiner*—Huyen Le
(74) *Attorney, Agent, or Firm*—Greenblum & Bernstein, P.L.C.

(57) ABSTRACT

A protrusion of the plug lid out of a bath tub is restricted to prevent the plug lid from being a hindrance, and water-tightness of the plug is improved. The plug lid is dropped into a notch formed in such a way that the circumferential edge of the plug lid becomes lower than the bottom surface of the bath tub. The packing closely contacts a packing close-contact surface narrowed from the bottom surface of the notch in a downward direction. The bottom part of the notch is formed into the horizontal plane and the plug lid is supported while it is not inclined under application of weight (such as a hydraulic pressure or an artificial pressure applied by a user) and the packing is protected from unnecessary crushing force.

15 Claims, 4 Drawing Sheets

RELATED ART

DRAIN PLUG STRUCTURE FOR BATH TUB

BACKGROUND OF THE INVENTION

1. Field of the Invention

This invention relates to a drain plug structure for use in opening or closing a drain port of a bath tab.

2. Related Art

As the related art, drain plug structure for a bath tub, it is well known in the art to provide a system in which the supporting member having a plug lid pivotally supported therein, for example, is held in the drain port and an operating part arranged at a position spaced apart from the supporting member is connected to the supporting member through a release wire, for example, Gazette of Japanese Patent Laid-Open No. Hei 9-60073.

Further, in the case of such a drain plug structure as described above, as shown in FIG. 5, a packing 102 arranged at a rear surface 101 of a plug lid 100 is closely contacted with a packing close-contact surface 103 of a drain port C to hold a water-tight state, so that there occurs a possibility that the plug lid 100 may protrude substantially from the bottom surface 104 of the bath tub and become a hindrance material when a person takes a bath.

In view of the foregoing, although the packing close-contact surface 103 is lowered by a certain step from the upper surface of the drain port C and a height of the plug lid 100 is made low a little as shown in the figure, practically it is lowered by an amount corresponding to a height lower than a thickness of the packing 102 and its practical effectiveness is quite low because of a wall thickness of a drain fitting for constituting the drain port and holding the supporting member, and a holding of the drain port diameter and the like.

Further, when it is desired to generate a clearance between the rear surface 101 of the plug lid and the upper surface of the drain port C and assure an amount of collapse of the packing 102 required for holding a water-tightness at this clearance under a state in which the packing 102 is closely contacted with the packing close-contact surface 103 because of the highest priority of assuring of the water-tightness, this clearance may become a cause for oppositely increasing an amount of protrusion of the plug lid 100 and the plug lid 100 becomes a step without a fail.

SUMMARY OF THE INVENTION

In view of the foregoing, it is a subject matter of the present invention to restrict a protrusion of the plug lid from the bottom part of the bath tub and decrease a possibility in which the plug lid becomes a hindrance and it is an object of the present invention to provide a drain plug structure resolving the subject matter described above.

Further, it is a subject matter of the present invention to improve a water-tightness in addition to the aforesaid subject matter and it is an object of the present invention to provide a drain plug structure solving the subject matter described above.

In order to accomplish the aforesaid objects, the present invention employed some technical means described below.

The technical means provides a drain plug structure for a bath tub using a remote-controlling type drain plug device, wherein this drain plug structure has a feature that at least a circumferential edge of the plug lid is set to be lower than the bottom surface of the bath tub under a drain port closed state (first aspect).

With such an arrangement as above, at least the circumferential edge of the plug lid is dropped into the drain port in such a way that it may not be contacted with a skin of a person and it becomes possible to position the top point of the plug lid in flush with the bottom surface of the bath tub or less than that in response to an amount of dropping. In this case, this plug does not become a hindrance and a safe and comfortable taking a bath can be assured.

The practical structure according to first aspect is a drain plug structure for a bath tub using a remote-controlled type drain plug device, for example, wherein the drain port is comprised of a notch part where it is dropped to become lower than the bottom surface of the bath tub under a closed state of the drain port and a packing close-contact surface placed lower than the bottom surface of the notch and having a smaller diameter than a diameter of the plug lid, and the packing is closely contacted with the packing close contact surface under a state in which the plug lid is dropped into the notch part (second aspect).

According to second aspect, the plug lid is dropped into the notch formed in such a way that the circumferential edge of the plug lid becomes lower than the bottom surface of the bath tub, the packing is closely contacted with the packing close-contact surface lower than the bottom surface of the notch.

Due to this fact, although the plug lid is dropped into the notch part, an amount of collapsing of the packing required for holding a water-tightness does not become a hindrance against dropping of the plug lid into the notch part.

Although the packing close-contact surface includes all the constitutions having the aforesaid actions, it is preferable that this packing close-contact surface has a constitution in which the surface is a narrow inclined surface where it is narrowed from the bottom surface of the notch in a downward direction (third aspect).

According to third aspect, a returning force of the packing itself from its deformation is added to a pushing force against the packing close-contact surface acting to the packing to increase a close-contact force because the packing is closely contacted with the packing close-contact surface while it is being crashed by the inclined surface and deformed.

In addition, it is the best way for the notch part to set a horizontal plane having the plug lid mounted thereon as a bottom surface (fourth aspect).

According to fourth aspect, the plug lid is supported at the horizontal plane without being inclined under application of a load (either a hydraulic pressure or an artificial pressure applied by a user) and a crushing force more than a requisite force is not acted on the packing.

As to a close contact characteristic, the packing is set such that the main body extending from the base part to its extremity end in narrow form is integrally arranged and at the same time, one or a plurality of more than two annular protrusions closely contacted with the packing close-contact surface are protruded at the main body and formed (fifth aspect), and the annular protrusions are closely contacted with the packing close-contact surface in a linear-contact form and this is effective in realizing a much higher close-contact characteristic.

In this case, it is preferable that the main body is formed such that its outer surface becomes a fine narrow shape having a convex curved surface from the upper edge of the end part to the bottom part, and annular protrusions are protruded at the convex curved surface (sixth aspect).

Then, a depth of the notch is set to such a value as one enabling the plug lid to be dropped into it in such a way that its top part may become in flush with the bottom surface of the bath tub or less than that (seventh aspect), thereby the plug lid is installed at the bottom part of the bath tub without being protruded.

In addition, the plug lid is removably fitted to the supporting shaft of the drain plug device (eighth aspect), thereby the plug lid can be removed through one-finger touch for performing a convenient repairing management.

As a practical example of the engagement or disengagement structure between the plug lid and the supporting shaft of the drain plug lid, there is provided a structure in which some axial slits are arranged at a fitting cylinder arranged at the plug lid and some protrusions are protruded inside the resilient pieces formed at several locations in a circumferential direction of it, fitting grooves where the protrusions are adapted to be fitted are set at the supporting shaft, the supporting shaft is inserted into the fitting cylinder, thereby the supporting shaft is contacted with the protrusions to expand and open the resilient pieces, when the protrusions are positioned at the fitting grooves, the resilient pieces are recovered from the expanded and opened state due to their resiliency to cause the protrusions to be fitted to the fitting grooves, wherein under a normal state of use, the plug lid is connected in such a way that it may not be removed from the supporting shaft, the plug lid is pulled out of the supporting shaft to cause the resilient pieces to be expanded and opened and the protrusions are escaped from the fitting grooves and the plug lid is removed (ninth aspect).

Additionally, when the anti-vibrating member sliding on the outer circumferential surface of the supporting member supporting the supporting shaft in such a way that it can be moved up and down is vertically installed at the plug lid, the plug lid is prevented from being vibrated and inclined (tenth aspect) and further the plug lid is provided with a foreign material mixing preventive cover sliding on the outer circumferential surface of the supporting member supporting the supporting shaft in such a way that it can be moved up and down, the foreign material mixing preventive cover has a cylinder part with its lower end being opened or released, the cylinder part has a length extending along the outer circumferential surface of the supporting member when the drain port is opened and when the drain port is closed, and then the foreign material is prevented from advancing into the supporting member when the drain port is opened (eleventh aspect).

DETAILED DESCRIPTION OF THE PREFERRED EMBODIMENTS

Figure 1:
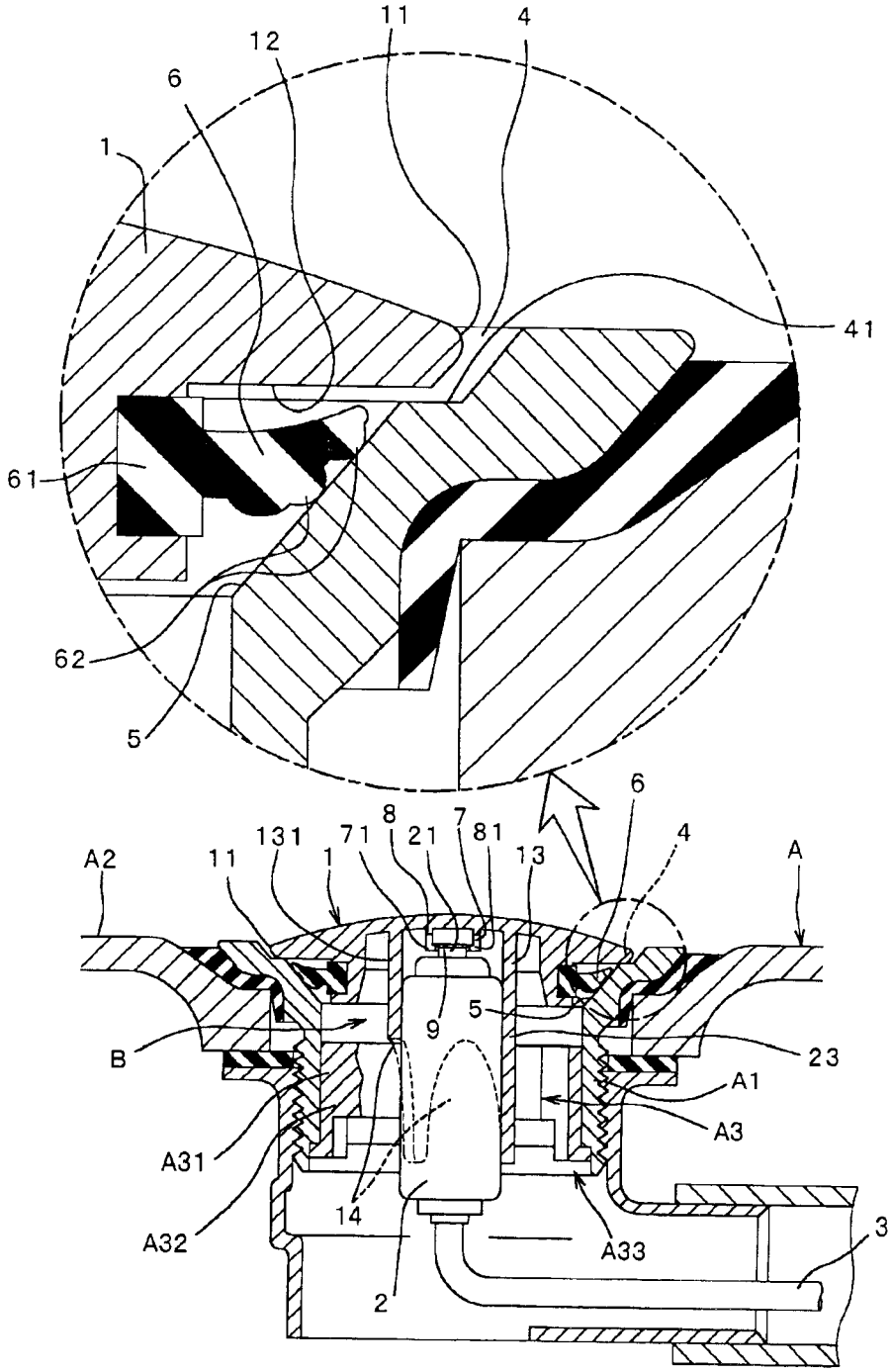
FIG. 1 is a sectional view for showing a drain plug structure of the present invention.
Figure 2:
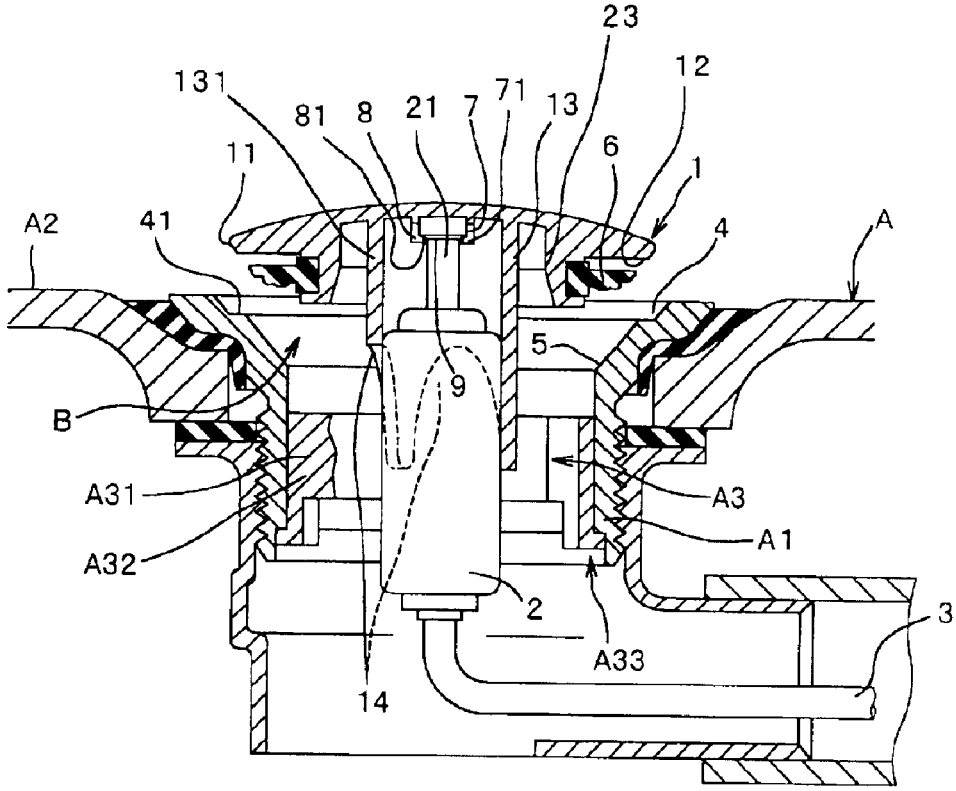
FIG. 2 is a sectional view for showing an opened state of a drain port.

Referring now to the drawings, some preferred embodiments of the present invention will be described as follows.

Further, an illustration and a description of an operating unit for the drain plug device of the present invention will he eliminated because basically the device has a well-known structure.

The supporting member 2 is held in a drain fitting A1 by a holding means A3 placed in the drain fitting A1 constituting the drain port B in such a way that it can be inserted into to or removed from it. However, as to the holding structure of the supporting member 2, this is not limited to a structure illustrated in the drawings.

A practical description about the constitution of the holding means A3 will be eliminated because the present applicant has already proposed in Gazette of Japanese Patent Laid-Open No. Hei 11-099077.

Further, the holding means A3 is integrally provided with a holding rind A32 removably attached to the drain fitting A1 through a rib A31 arranged in a radial direction from an outer circumferential surface of the supporting member 2, and a fitting means A33 is arranged over the holding ring A32 and the drain fitting A1 so as to hold the supporting member 2 in the drain fitting A1 in such a way that it can be inserted into or removed from it.

Next, the drain plug structure of the present invention will be described more practically.

A drain port B is constituted by a notch 4 having a depth where a circumferential edge 11 of the plug lid 1 is embedded at its upper surface, and a packing close-contact surface 5 becoming a narrow extremity end slant surface from a horizontal surface 41 of a bottom part of the notch 4 to a downward direction.

The horizontal surface 41 acting as the bottom part of the notch 4 and the packing close-contact surface 5 are positioned lower than the bottom surface A2 of the bath tub, thereby the circumferential edge 11 of the plug lid 1 and a packing 6 to be described later are positioned at a lower place than the bottom surface A2 of the bath tub.

The packing 6 for being closely contacted with the packing close-contacted surface 5 to keep a water-tight state is arranged below the plug lid 1.

The packing 6 is arranged to be spaced apart from the rear surface 12 of the plug lid 1, a clearance between the packing 6 and the rear surface 12 becomes a deformed space for the packing 6, wherein the packing 6 is deformed to be peeled up through inclination of the packing close-contacted surface 5 under a closed state of the plug lid 1 and then its recovering force from its deformation may also act as the close contact force.

The packing 6 is made such that its main body 61 is formed to have a shape narrowing toward its extremity end from its base part and at the same time its outer surface ranging from the upper edge of the end part to the bottom part is formed as a convex curved surface.

In addition, two annular protrusions 62 coaxial with the packing 6 are provided at the rear surface of the packing 6 and the water-tight state is held while the annular protrusions 62 may closely be contacted with the packing close-contacted surface 5 in a line-contact state.

A connected structure between the plug lid 1 and the supporting shaft 21 of the supporting member 2 is set such that a fitting cylinder 7 integrally protruded at the rear surface 12 of the plug lid 1 is removably fitted to the supporting shaft 21.

More practically, a large number of axial slits 71 are arranged at the fitting cylinder 7 to form resilient pieces 8 at several locations in a circumferential direction, protrusions 81 are protruded inside the extremity ends of the resilient pieces 8 and in turn the supporting shaft 21 is provided with fitting grooves 9 to which the protrusions 81 may be fitted in an adapted state.

In the case that the plug lid 1 is fixed to the supporting shaft 21 in such a connected structure as above, the fitting cylinder 7 is pushed against the extremity end of the supporting shaft 21 and pushed into it while it is being kept, resulting in that the resilient pieces 8 are recovered from their expanded and opened state due to their resiliency when the protrusions 81 are positioned at the fitting grooves 9 to cause the protrusions 81 to be fitted to the fitting grooves and the plug lid 1 is fixed.

Under a state in which the plug lid 1 is fixed to it, the extremity end of the supporting shaft 21 is inserted into the fitting cylinder 7, the protrusions 81 of the resilient pieces 8 are fitted to the fitting groove 9 and the connected state is held with the resilient force of the resilient pieces 8 under a normal opening or closing operation of the plug lid 1.

When the plug lid 1 is removed, the plug lid 1 is pulled out of the supporting shaft 21, resulting in that a force escaping from the fitting groove 9 may act against the protrusions 81 to cause the resilient pieces 8 to be expanded and opened and further cause the protrusions 81 to be removed from the fitting groove 9 and the plug lid 1 is removed from it.

That is, under the closed state of the plug lid 1, it is possible to cause a tension force of the thrust lock mechanism acting against the supporting shaft 21 to act as a pushing force against the packing close-contacted surface 5 of the packing 6 and at the same time, a pulling-out the plug lid 1 from the supporting shaft 21 enables its repairing or maintenance work to be easily carried out.

An anti-vibrating member 13 sliding at an outer circumferential surface of the supporting member 2 is arranged vertically at the rear surface of the plug lid 1.

Figure 4:
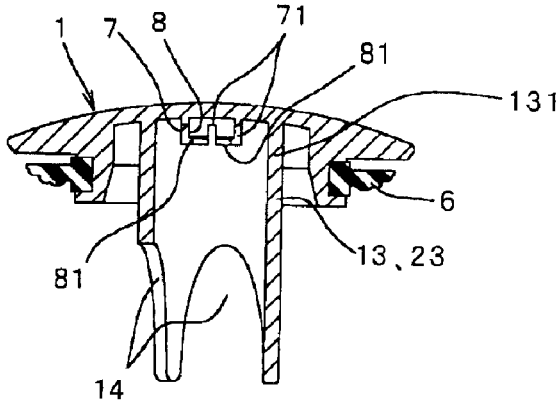
FIG. 4 is a sectional view for showing another preferred embodiment.
Figure 5:
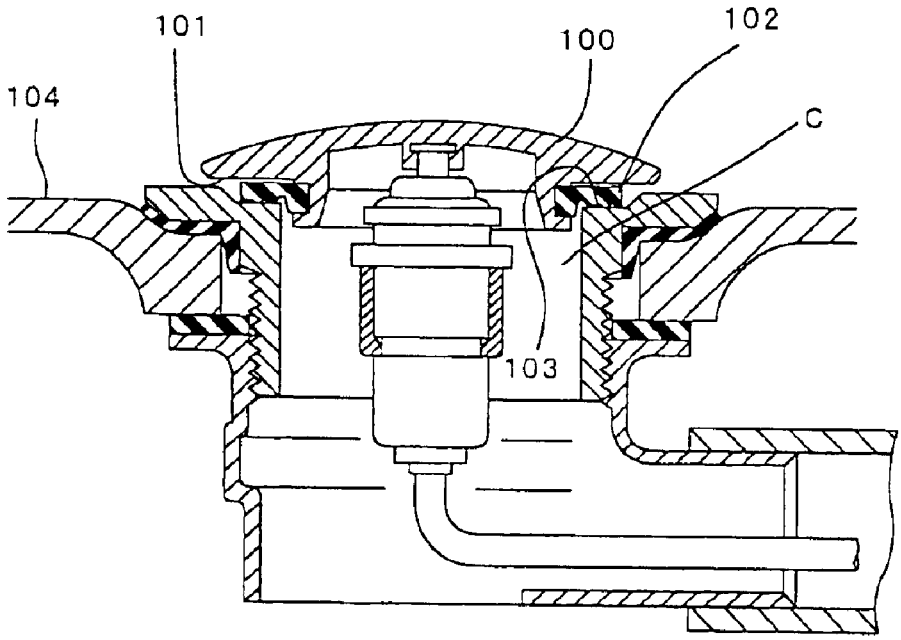
FIG. 5 is a sectional view for showing the related art drain plug structure.

The anti-vibrating member 13 has a cylindrical part 131 having such an inner diameter as one to be fitted to the supporting member 2 and slid against it. Axial slits 14 of which number corresponds to that of the ribs A31 so as to avoid the ribs A31 during a moving-up and/or moving-down operation of the supporting shaft 21 are formed at the lower end of the cylindrical part 131 (refer to FIG. 4).

The anti-vibrating member 13 is moved up or down and guided by the supporting member 2 as the plug lid 1 is moved up or down by the supporting shaft 21.

Even if the plug lid 1 is lifted up by the supporting shaft 21 (the drain port is in an opened state), a length of the cylindrical part 131 is set to such a length as one extending along an outer circumferential surface of the supporting member 2 to prevent either vibration or inclination of the supporting shaft 21 from being produced.

Additionally, this anti-vibrating member 13 may also act as a foreign material mixing preventive cover 23 for preventing some foreign materials mixed in the drain water from entering through a supporting guide hole (not shown) opened at the supporting member 2 into the supporting member 2.

With the foregoing, although it has been described that the anti-vibrating member 13 may also act as the foreign material mixing-preventive cover 23, it is optional that some guide legs (not shown) extending along the outer circumferential surface of the supporting member 2 from the plug lid 1 are spaced apart in a circumferential direction and vertically installed to accomplish only the anti-vibrating action and then the anti-vibrating member is constituted by a plurality of guide legs.

The preferred embodiment described above has been illustrated under a state in which the circumferential edge of the plug lid is embedded into the notch part. However, in addition to this form, it is also possible to attain a form in which a depth of the notch is set to such a depth as one having a top point of the plug lid in flush with the bottom surface of the bath tub and the entire plug lid is embedded into the notch (not shown) or another form in which as shown in FIG. 3, a height of the plug lid 1 is made low, the upper surface of the plug lid 1 is made flat or gradual arc (not shown) to cause the entire plug lid 1 to be embedded and the bottom surface A2 of the bath tub is made flat or substantially flat.

Figure 3:
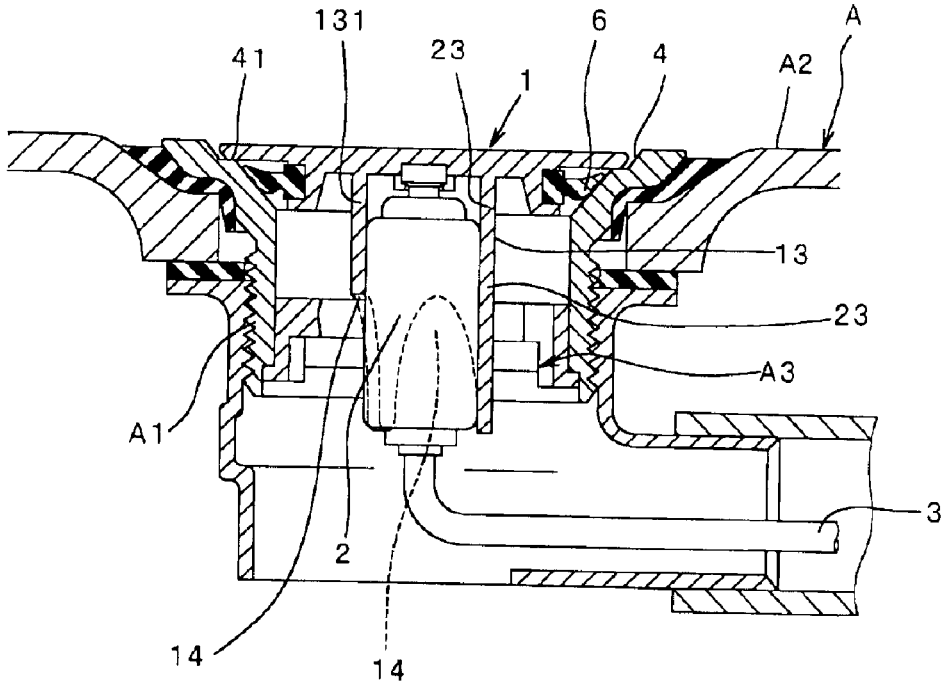
FIG. 3 is a sectional view for showing a plug lid.

Further, the similar reference numerals are applied to the structure shown in FIG. 3 because its components other than those of the plug lid are similar to those of the structure shown in FIG. 1.

As described above, the present invention has some superior effects as follows.

According to first aspect of the invention, the plug lid is constructed to have a configuration in which the plug lid is dropped into the drain port under a closed state of the drain port, so that it is also possible to prevent the circumferential edge of the plug lid from being exposed, an operator's hand or fingers from being engaged with the circumferential edge and further the plug lid from being protruded out of the bottom surface of the bath tub in response to an amount of dropping of the plug lid, resulting in that a person taking a bath can enjoy it in a comfortable manner without having any irregular feeling caused by some hindrances.

In addition, according to second aspect of the invention, a recovering force of the packing itself is added to a pushing force against the packing close-contact surface acting on the packing.

Accordingly, a close-contact force of the packing against the packing close-contact surface is reinforced and a superior water-stopping characteristic is realized.

Additionally, the circumferential edge of the plug lid is dropped into the notch formed to be lower than the bottom surface of the bath tub; the packing is closely contacted with the packing close-contact surface lower than the bottom surface of the notch, thereby a load applied to the plug lid (a hydraulic pressure or an artificial pressure provided by a user) can be accepted while being divided by the plug lid and the packing.

Accordingly, it is possible to prevent a load from being concentrated on one of the plug lid or the packing, it may substantially contribute to an improvement of durability of the plug lid and the packing.

In addition, according to third aspect of the invention, the packing is closely contacted with the packing close-contact surface while it is being crushed by the inclined surface and deformed, so that its close-contact force is increased while the returning force of the packing itself from its deformation is added to the pushing force against the packing close-contact surface acting on the packing and a more positive water stopping state can be realized.

In addition, according to fourth aspect of the invention, the plug lid is not inclined to open the drain port and no useless load is applied to the packing to perform a positive stopping of water because the plug lid is supported by a horizontal plane with an applied load (a hydraulic pressure or an artificial pressure applied by a person) and a crushing force more than a requisite force is not acted on the packing, resulting in that there is no possibility that a durability of the packing is deteriorated.

Further, according to fifth and sixth aspects of the invention, a further higher contribution can be applied to an improvement of water-tightness because the annular protrusions of the packing are closely contacted with the close-contact surface of the packing in a line-contact state.

Additionally, according to seventh aspect of the invention, the plug lid can be installed at the bottom part of a bath tub without being protruded because a depth of the notch part is set to such a value as one in which the plug lid can be dropped into the bottom part of the bath tub while its top part is in flush with or less than the bottom part of the bath tub.

Further, in the case of the inventions according to eighth aspect and ninth aspect, a more superior water stopping characteristic can be attained because a tension force of the supporting shaft can also be acted as a pushing force of the packing against the packing close-contact surface, and a repairing or maintenance work can be easily carried out if the plug lid is pulled out of the supporting shaft in an artificial manner.

In addition, according to tenth aspect of the invention, the plug lid is prevented from being vibrated or inclined to make a positive guiding of its opening or closing operation because the anti-vibrating member sliding on the outer circumferential surface of the supporting member for supporting the supporting shaft in such a way that it can be moved up and down, resulting in that the plug lid may not close the drain port due to its vibration or inclination, the water stopping does not become incomplete and a predetermined water stopping characteristic can be maintained stably until its durable limit time. Further, according to eleventh aspect of the invention, some foreign materials mixed into the drain water are not flowed into the supporting member and there is no possibility that neither trouble nor poor operation may be produced because the plug lid is provided with a foreign-material mixing preventive cover sliding on the outer circumferential surface of the supporting member supporting the supporting shaft in such a way that it can be moved up and down, the foreign material mixing preventive cover has a cylindrical part with its lower part being opened or released, and the cylindrical part has a length extending along the outer circumferential surface of the supporting member when the drain port is opened and when the drain port is closed (eleventh aspect).

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A drain plug structure for a bath tub using a remote-controlling type drain plug device for use in a drain port having a notch part, comprising:

a plug lid having a circumferential edge, the circumferential edge of the plug lid configured to be lower than a bottom surface of the bath tub under a drain port when the drain plug is closed; and a packing having an outwardly-convex shape which upwardly tapers from a first thickness at an end attached to the drain plug to a second thickness narrower than the first thickness, wherein the plug lid includes a clearance between a rear edge of the plug lid and the packing, and wherein the packing deforms into the clearance when the circumferential edge of the plug lid is dropped into the notch part.

2. A drain plug structure for a bath tub according to claim 1, wherein the plug lid is removably fitted to a supporting shaft of the drain plug device.

3. A drain plug structure for a bath tub according to claim 1, further comprising:

a fitting cylinder at the plug lid, having a plurality of axial slits, as an engagement or disengagement structure between the plug lid and a supporting shaft of said drain plug lid;

a plurality of protrusions protruded inside a plurality of resilient pieces formed at several locations in a circumferential direction of the fitting cylinder; and a plurality of fitting grooves where the protrusions are adapted to be fitted, on supporting shaft, wherein the supporting shaft is inserted into the fitting cylinder, contacting said protrusions to expand and open the resilient pieces, and when the protrusions are positioned at the fitting grooves, the resilient pieces are recovered from the expanded and opened state due to their resiliency to cause the protrusions to be fitted to the fitting grooves, wherein under a normal state of use, the plug lid is connected in such a way that it may not be removed from the supporting shaft, and wherein the plug lid is pulled out of the supporting shaft to cause the resilient pieces to be expanded and opened and the protrusions are escaped from the fitting grooves and the plug lid is removed.

4. A drain plug structure for a bath tub according to claim 3, further comprising an anti-vibrating member configured to slide on the outer circumferential surface of the supporting member supporting the supporting shaft in such a way that the anti-vibrating member can be moved up and down, wherein the anti-vibrating member is vertically installed at the plug lid.

5. A drain plug structure for a bath tub according to claim 3, wherein the plug lid includes a foreign material mixing preventive cover configured to slide on the outer circumferential surface of the supporting member supporting the supporting shaft in such a way that it can be moved up and down, wherein said foreign material mixing preventive cover has a cylinder part with a lower end thereof being opened or released, and wherein said cylinder part has a length extending along the outer circumferential surface of the supporting member when the drain port is opened and when the drain port is closed.

6. A drain plug structure for a bath tub using a remote-controlling type drain plug device for use in a drain port having a notch part, comprising:

a plug lid having a circumferential edge, the circumferential edge of the plug lid configured to be lower than a bottom surface of the bath tub under a drain port is closed; and a packing having an outwardly-convex shape which upwardly tapers from a first thickness at an end attached to the drain plug to a second thickness narrower than the first thickness, the packing including a close-contact surface lower than a bottom surface of the notch part, wherein the close-contact surface has a diameter smaller than a diameter of the plug lid, wherein the plug lid includes a clearance between a rear edge of the plug lid and the packing, wherein the packing deforms into the clearance when the circumferential edge of the plug lid is dropped into the notch part, and wherein the packing closely contacts the close-contact surface when the plug lid is dropped into the notch part.

7. A drain plug structure for a bath tub according to claim 6, wherein the close-contact surface is a narrow inclined surface extending from the bottom surface of the notch in a downward direction.

8. A drain plug structure for a bath tub according to claim 7, wherein said notch part is set such that a horizontal surface supporting and mounting the plug lid is applied as a bottom surface.

9. A drain plug structure for a bath tub according to claim 8, wherein the packing has a main body extending from a base part to an extremity end in narrow form, the packing being integrally arranged, and wherein at least one annular protrusion closely contacts the packing close-contact surface protruded at said main body.

10. A drain plug structure for a bath tub according to claim 8, wherein a main body of the packing is formed such that its outer surface becomes a fine narrow shape having a convex curved surface from an upper edge of an end part to a bottom part, and annular protrusions are protruded at said convex curved surface.

11. A drain plug structure for a bath tub according to claim 8, wherein the notch part has a depth enabling the plug lid to be dropped into the notch part in such a way that a top part of the plug lid flushly contacts the bottom surface of the bath tub.

12. A drain plug structure for a bath tub according to claim 11, wherein the plug lid is removably fitted to a supporting shaft of the drain plug device.

13. A drain plug structure for a bath tub according to claim 11, further comprising:

a fitting cylinder at the plug lid, having a plurality of axial slits, as an engagement or disengagement structure between the plug lid and a supporting shaft of said drain plug lid;

a plurality of protrusions protruded inside a plurality of resilient pieces formed at several locations in a circumferential direction of the fitting cylinder; and a plurality of fitting grooves where the protrusions are adapted to be fitted, on supporting shaft, wherein the supporting shaft is inserted into the fitting cylinder, contacting said protrusions to expand and open the resilient pieces, and when the protrusions are positioned at the fitting grooves, the resilient pieces are recovered from the expanded and opened state due to their resiliency to cause the protrusions to be fitted to the fitting grooves, wherein under a normal state of use, the plug lid is connected in such a way that it may not be removed from the supporting shaft, and wherein the plug lid is pulled out of the supporting shaft to cause the resilient pieces to be expanded and opened and the protrusions are escaped from the fitting grooves and the plug lid is removed.

14. A drain plug structure for a bath tub according to claim 13, further comprising an anti-vibrating member configured to slide on the outer circumferential surface of the supporting member supporting the supporting shaft in such away that the anti-vibrating member can be moved up and down, wherein the anti-vibrating member is vertically installed at the plug lid.

15. A drain plug structure for a bath tub according to claim 13, wherein the plug lid includes a foreign material mixing preventive cover configured to slide on the outer circumferential surface of the supporting member supporting the supporting shaft in such a way that it can be moved up and down, wherein said foreign material mixing preventive cover has a cylinder part with a lower end thereof being opened or released, and wherein said cylinder part has a length extending along the outer circumferential surface of the supporting member when the drain port is opened and when the drain port is closed.

* * * * *

UNITED STATES PATENT AND TRADEMARK OFFICE

CERTIFICATE OF CORRECTION

PATENT NO. : 6,904,623 B2
APPLICATION NO. : 10/629616
DATED : June 14, 2005
INVENTOR(S) : Ohta et al.

It is certified that error appears in the above-identified patent and that said Letters Patent is hereby corrected as shown below:

At column 8, line 11 (claim 3, line 11) of the printed patent, after "on" insert ---a---.

At column 10, line 2 (claim 13, line 11) of the printed patent, after "on" insert ---a---.

At column 10, line 20 (claim 14, line 4) of the printed patent, "away" should be ---a way---.

Signed and Sealed this

Eighth Day of August, 2006

JON W. DUDAS
*Director of the United States Patent and Trademark Office*